United States Patent [19]

Kahelin

[11] 3,930,486

[45] Jan. 6, 1976

[54] CONVERTIBLE BASEBALL AND TENNIS PRACTICE MACHINE

[76] Inventor: Edward W. Kahelin, 812 Fifth St., Manhattan Beach, Calif. 90266

[22] Filed: June 17, 1974

[21] Appl. No.: 479,747

Related U.S. Application Data

[63] Continuation-in-part of Ser. No. 293,020, Sept. 28, 1972, Pat. No. 3,838,676.

[52] U.S. Cl. ..... 124/11 R; 124/30 R; 124/34; 124/49

[51] Int. Cl.[2] ..... F41F 1/04

[58] Field of Search ..... 124/6, 9, 11 R, 30 R, 34; 273/26 D, 29 A

[56] References Cited

UNITED STATES PATENTS

| | | | |
|---|---|---|---|
| 592,221 | 10/1897 | Wells et al. | 124/34 |
| 3,018,769 | 1/1962 | Parsoneault | 124/11 R |
| 3,277,879 | 10/1966 | Sayette | 124/30 R X |
| 3,467,073 | 9/1969 | Rhodes | 124/11 R |
| 3,568,653 | 3/1971 | Earle, Jr. et al. | 124/9 X |
| 3,585,978 | 6/1971 | Hurlimann | 124/6 |
| 3,602,208 | 8/1971 | Hurlimann | 124/6 |
| 3,640,263 | 2/1972 | Rhodes | 124/11 R |
| 3,724,437 | 4/1973 | Halstead | 273/26 D X |

FOREIGN PATENTS OR APPLICATIONS

| | | | |
|---|---|---|---|
| 901,386 | 1/1954 | Germany | 124/11 R |
| 406,430 | 12/1909 | France | 124/34 |
| 622,156 | 6/1961 | Italy | 124/11 R |

*Primary Examiner*—Richard C. Pinkham
*Assistant Examiner*—R. T. Stouffer
*Attorney, Agent, or Firm*—Robert O. Richardson

[57] ABSTRACT

An improved compressed fluid ball projecting machine convertable for baseball and tennis practice. Improvements are in maneuverability, oscillation of the tennis barrel and immobility of the baseball barrel, remote control power for coaching options, replaceable and interchangeable barrels, variable timer speed control and a reliable hopper and feed system to enable firing of up to two hundred tennis balls unattended and without malfunction. Regarding the oscillation or lack of oscillation of the barrel, an actuator rod mounted on a rotatable disc causes such oscillation. When this rod is removed and the barrel clamped, this oscillation is eliminated. Concerning the variable timer control, such control is varied by two relatively movable rotatable notched discs. These dics contact a valve actuating mechanism and permit opening of a valve operated thereby only when the notches of the pair of discs are aligned and in contact with the valve actuating mechanism.

6 Claims, 8 Drawing Figures

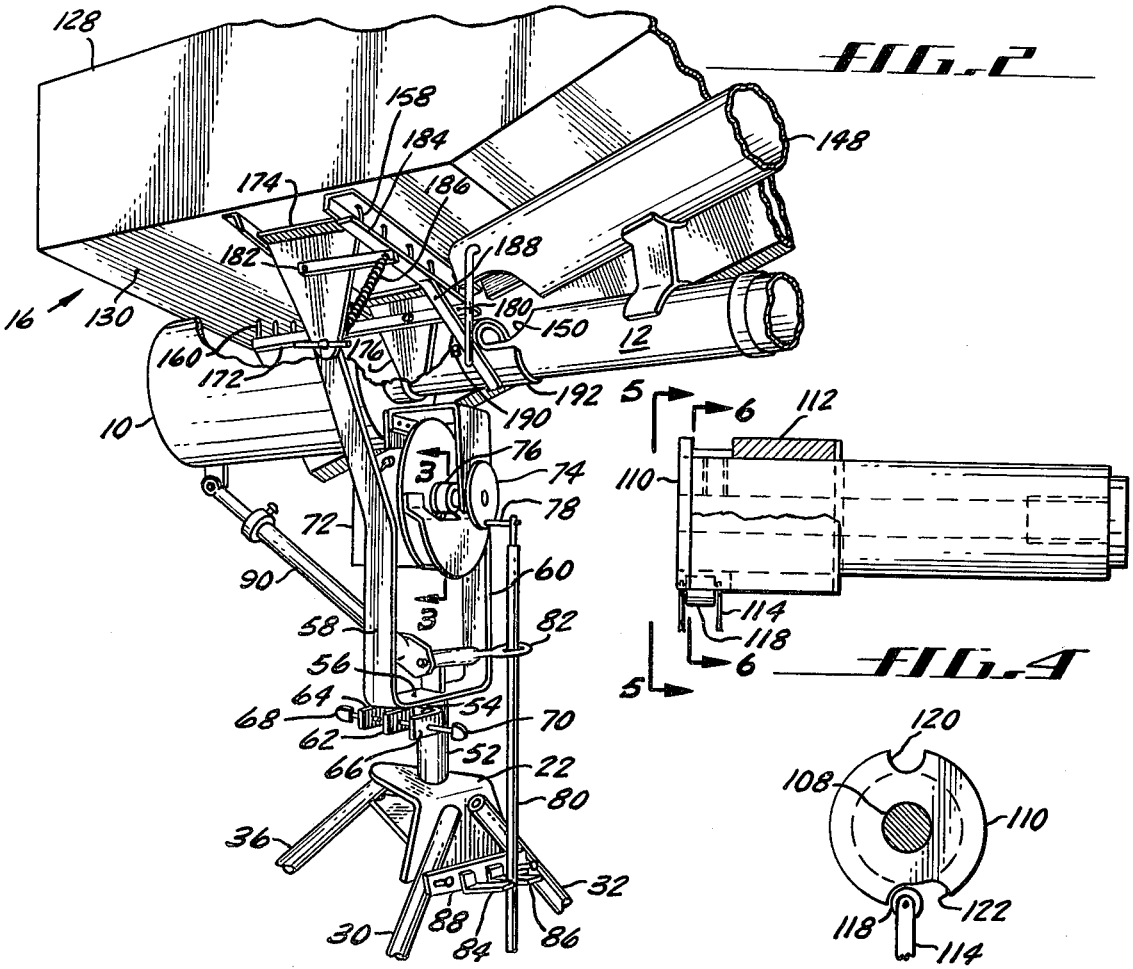
FIG. 2
FIG. 4
FIG. 5
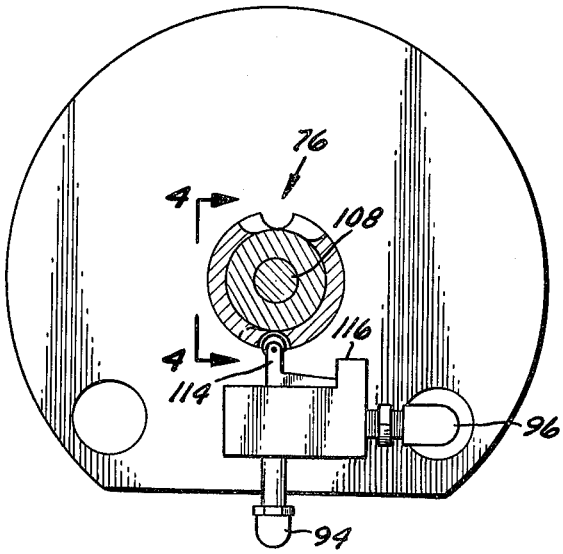
FIG. 3
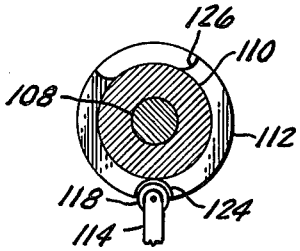
FIG. 6

CONVERTIBLE BASEBALL AND TENNIS PRACTICE MACHINE

This application is a continuation-in-part of co-pending application Ser. No. 293,020 filed Sept. 28, 1972. and now Pat. No. 3,838,676.

RELATED INVENTIONS

The present invention is an improvement over the apparatus shown and described as a Baseball Pitching and Fielding Practice Device in Pat. No. 3,018,769 which issued Jan. 30, 1962, to F. L. Parsoneault. The details of that patent are hereby incorporated herein as if fully set forth and reference is made to that patent for an understanding of the present invention and its advantages over the prior art. Both the Parsoneault patent and the present invention are presently owned by K-Lin Specialties, Inc., 812 Fifth Street, Manhattan Beach, Calif. 90266, and apparatus currently marketed by them will incorporate the improvements set forth in the present application.

An improvement to the Parsoneault machine is set forth in applicant's co-pending application Ser. No. 293,020 filed Sept. 28, 1972 for Ball Throwing Machine, now U.S. Pat. NO. 3,838,676. In that application improvements were made in the basic machine, feed mechanism and in a plurality of barrel extensions for high and low velocity baseball ejection and for throwing tennis balls. In that application, applicant elected the invention most suitable to Little League use and in particular a barrel extension for that purpose. Reference is made to that application for an understanding of common subject matter.

BACKGROUND OF THE PRESENT INVENTION

Tennis and baseball are seasonal activities. A tennis ball throwing machine and a baseball throwing machine may have many features and structural parts in common as well as features and parts unique with each activity. To have separate machines for each activity requires additional storage and greater investment than a single machine with quickly and easily converted attachments for adapting the machine for multiple uses.

A convertable baseball and tennis practice machine has a market in all baseball activities from Little League, up through high school, college and professional ranks. Additionally, private clubs and public parks with tennis courts have a use for such a machine. Commercial operators can now convert seasonally from one activity to the other and keep their commercial facilities open for longer seasonal periods. This, of course, enhances their profit potential.

In making a machine convertable many problems arise because of the basic differences between tennis balls and baseballs and between the various baseballs themselves and between the various tennis balls. The barrels must accommodate these differences and still eject the balls accurately and reliably. Also a feed mechanism must accommodate up to 200 tennis balls, without jamming or malfunctioning and feed any kind of baseball or tennis ball into the ejection barrel without operator assistance.

Whereas baseballs should be pitched accurately and consistently for batting practice, tennis balls should be hurled both accurately for beginners and randomly over a net to give the experienced player practice in specific shots and in following a ball as an opponent might return it. Also the velocity of the ball should vary.

Still another problem is in transporting the machine and moving it onto and off a tennis court or baseball batting area, making it quickly dismantable or assembled for use, and still have a machine that will stay stable when in use.

SUMMARY OF PRESENT INVENTION

In accordance with the present invention improvements and modifications have been made to the Parsoneault machine and to the machine shown and described in my co-pending application Ser. No. 293,020 of which this is a continuation-in-part. In particular, modifications have been made in at least six areas. Wheels have been added to two legs of the tripod support and a detachable tote bar with wheel supports the third leg in a manner that the machine may be moved about easily yet remain in position when in use. The machine may have the barrel pointed in a fixed direction and attitude or it may be converted quickly to oscillate sideways to fire tennis balls into different areas of the tennis court. A variable timer will cause consistent rhythmatical firing at uniform firing pressure and ball ejection speed or in the alternative will cause firing at non-uniformly spaced time intervals and firing pressures. A remote control is provided so that a coach may initiate ball ejection as desired. Replaceable barrel extensions are used in converting from Little League to professional baseball and to tennis practice, and, finally a hopper and feed mechanism is used that will permit up to two hundred tennis balls to be stored and ejected without operator assistance.

The detachable tote bar has a handle, wheel and a pivotal connecting rod that is insertable into the hollow end of the rear tripod leg. When the handle is moved downwardly, the wheel acts as a fulcrum and the rear leg raises off the ground. The machine is then on three wheels and is easily moved with the handle which also may be used for steering the machine into desired position since the tote bar wheel is pivotal on the rear leg.

A timing motor initiates the opening of a valve to release compressed air behind the ball in the barrel for ejection. This same timing motor rotates a timing disc under the barrel so the baseball batter can judge the timing of his swing at the ejected ball in a manner similar to observing the body position of a pitcher when he releases the ball. To cause sideways oscillation of the machine for tennis use a rod is pivotally mounted on the rotating disc spaced from its center so that the upper end of the rod moves in a vertical circle. The lower end of the rod fits between a pair of fingers on a bracket between the front two legs of the tripod support. The rod moves up and down but not sideways between these fingers. The firing barrel fits onto a pivotal post at the apex of the tripod. The firing barrel also has an eye bolt fastened below it through which the rod passes. The sideways movement of the upper part of the rod and the non-movement sideways of the lower end forces lateral movement of the eye bolt and hence the firing barrel oscillates sideways. By moving the eye of the eye bolt up or down the lateral range of oscillation can be varied. With the rod removed, the firing barrel will not oscillate and a clamping bracket with adjusting screws retains the barrel in a fixed firing position. An adjustable brace from the apex of the tripod to the rear of the machine is used to set the pitch attitude of the barrel.

A pneumatic valve controls the firing of the ball as the timing motor rotates the timing disc. Mounted on the timing motor shaft is a pair of timing plates with notches. The pneumatic valve has a roller that rides on the edges of the two timing plates and depresses when the notches of both plates are rotatable relative to each other and then held together with a pin to vary the arrangement of the aligned notches and hence the time of firing of the balls. The notches on the plates are so arranged that firing occurs rhythmatically once every 360°, once every 180°, or at 150° and 360° spacing as desired. This provides for alternate firing in relatively faster sequence and slower sequence. When used with the oscillator tennis balls are ejected along different positions across the tennis court. This non-uniform firing also varies the speed since the pressure in the ball ejection tank is less when rapid firing occurs and is greater for the slower firing sequence.

Normally, a continuous supply of air is present at the inlet of the pneumatic timer valve. Remote control is achieved by inserting another pneumatic valve in front of the timer valve. This additional pneumatic valve is coach operated by means of controlling the static pressure in a single length of air hose attached at one end to the pneumatic valve and with a normally closed bleed valve at the coach's end of the hose. Wherever static pressure is allowed to build up in the hose, the remote control pneumatic valve remains open and allows pressure to reach the pneumatic timer valve without interruption, thus allowing the machine to fire as the rotating discs permit. Conversely whenever the pressure in the static hose is released by means of the bleed valve at the coach's position, the remote control pneumatic valve closes and does not allow pressurized air to reach the pneumatic timer valve. This prevents further firing of the machine until the coach elects to release the bleed vent, thus allowing the hose to pressurize and permitting pressurized air to reach the pneumatic timer and subsequent firing occurs when the appropriate timer discs dictate.

The tennis barrel extension is of smaller diameter and fits into the machine barrel. It has slots to permit air escape for a reduction in speed of ejected tennis balls. On the outer end of the extension are other slots into which may be inserted strips having bristles, rubber fingers, rollers or other ball influencing elements. These strips may be placed at the top, bottom or either side and are held in place by resilient bands or loops which permit slight outward movement as the ball passes the strips.

The hopper and feed mechanism to accommodate up to two hundred tennis balls without jamming or malfunction and without operator assistance includes an endless chain with scoops to carry balls from the lower rear end of the hopper up to the upper forward end where the balls roll down a ramp and into a hole with a chute under it conveying the balls down to the opening in the barrel. When the chute is full, the balls recycle into the top of the hopper. Anti-clogging and jamming features and apparatus within the hopper assures a reliable flow of balls to the machine. In order to feed tennis balls to the chute at a faster desired rate (baseballs fire once per revolution of the timing discs and tennis balls fire twice per revolution) the endless chain in conveying tennis balls must travel at twice the speed as in conveying baseballs. This is accomplished by having two different sized drive sprockets interchangeable for the desired operational mode.

BRIEF DESCRIPTION OF DRAWINGS

FIG. 2 is an enlarged fragmentary perspective view with parts broken away to illustrate better certain features, FIG. 3 is a sectional view of the variable timer taken along the line 3—3 in FIG. 2, FIG. 4 is a side view taken along the line 4—4 in FIG. 3, FIG. 5 and FIG. 6 are sectional views taken respectively along lines 5—5 and 6—6 of FIG. 4.

DETAILED DESCRIPTION OF ILLUSTRATIVE EMBODIMENT

Figure 1:
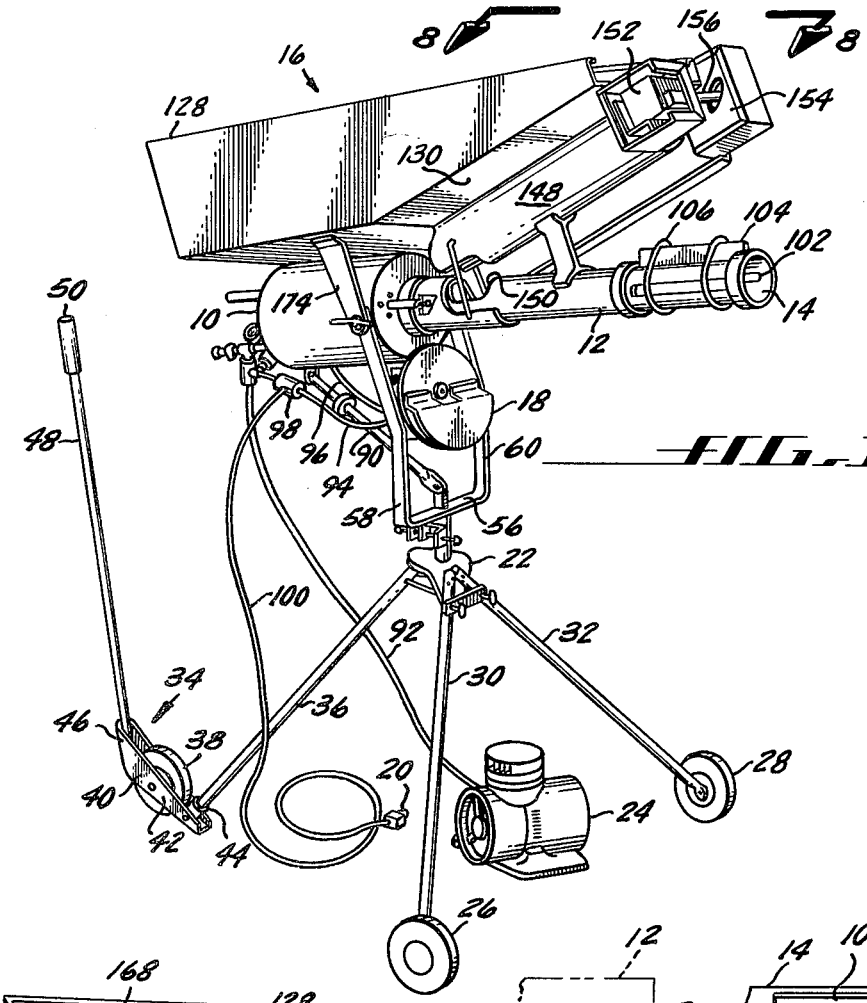
FIG. 1 is a view taken in perspective of the convertable baseball and tennis practice machine.

Referring now to FIG. 1 there is shown a compressed air supply tank 10, ejection barrel 12 with barrel extension 14, hopper and feed mechanism 16, variable timer speed control 18, and coach's remote power control 20 mounted on a tripod support 22. A gas engine powered air compressor 24 is removably attached to supply tank 10.

Tripod support 22 has a pair of wheels 26,28 fixedly mounted on its front legs 30,32 and a tote bar 34 removably connected to the rear leg 36. This tote bar consists of a wheel 38 rotatably mounted on a lever 40 for which it serves as the fulcrum. Lever 40 has a first lever arm 42 having a leg holder 44 pivotally mounted at its end. This leg holder 44 includes a pin (not shown) insertable in the hollow end of tubular leg 36. The weight on leg 36 causes the end of lever arm 42 to rest on the ground to stabilize the tripod. The other end of lever 40 is a lever arm 46 having a shaft 48 affixed thereto. A handle 50 at the top of shaft 48 is used, when tilted down, to raise the end of lever arm 42 off the ground and push or pull the machine as desired. The tote bar may be detached from the machine by simply tilting the machine forwardly and letting the pin on the end of leg holder 44 drop out from within the hollow end of leg 36.

Since some of the oscillator structure has not been shown in FIG. 1, reference is made to FIG. 2 for an understanding of its construction and operation. Rigidly mounted on top of tripod 22 is a vertical hollow mounting tube 52 on which is fastened a U-bracket 54. A Y-mounting support 56 consists of arms 58,60 and a downwardly extending leg, not shown, that rotatably fits within mounting tube 52. A stop lug 62 fits between ears 64,66 of clamping bracket 54. Adjusting screws 68,70 are threadedly mounted on ears 64,66 and may have their ends closed against lug 62 to prevent lug 62, and therefore, support 56, from rotating. Ball firing barrel 12 is thus fixed in its angular rotation, as desired in the firing of baseballs. However, by opening up bracket 54, by spacing apart the ends of bolts 68,70, lug 62 may be rotated between the bolt ends. This permits, but does not cause, rotation or oscillation of Y-support 56 and hence barrel 12. This feature is desired in firing tennis balls.

The oscillation of barrel 12 to simulate an opponent returning tennis balls is done with a timer motor 72 which is connected to a rotating timing disc 74 through a variable timer switch valve 76. This disc 74 has an offset pin 78. An actuator rod 80 is rotatably mounted on pin 78 and extends downwardly through an eye-bolt 82 mounted on Y-support 56 and its lower end fits between a pair of fingers 84,86 on bracket 88 mounted between front legs 30,32 of tripod support 22. The upper end of rod 80 moves in a vertical circle as pin 78 rotates with disc 74 and the lower end of rod 80 moves up and down but not sideways between these fingers. This action of rod 80 causes lateral movement of eye bolt 82 and hence the ball firing barrel 12 oscillates sideways. Since eye bolt 82 is pivotally mounted on support 56, the eye of the eye bolt may be moved up or down to vary the lateral range of oscillation of barrel 12. With rod 80 removed, the firing barrel 12 will not oscillate and the clamping bracket 54 with adjusting screws 68,70 retain the barrel in fixed position. An adjustable brace 90 extending from the support 56 to the rear of air supply tank 10 is used to set the pitch or elevation attitude of the barrel.

Referring back to FIG. 1, a continuous supply of air normally passes from compressor 24, through lines 92,94 and 96 to air supply tank 10. Remote control is achieved by inserting pneumatic valve 98 in line 94. This valve is coach operated by means of a single length of air hose 100 attached at one end to valve 98. A normally closed bleed valve at the other end becomes the coach's remote power control 20. Whenever pressure builds up in hose 100, pneumatic valve 98 remains open and allows pressure to reach the timer valve without interruption, thus allowing the machine to fire as the rotating timing discs (to be described) permit. Conversely, whenever the coach depresses control 20 to release pressure in static hose 100, remote control valve 98 closes and does not allow pressurized air to reach the pneumatic timer valve. This prevents further firing of the machine until the coach elects to release control 20, allowing hose 100 to pressurize and permitting air to reach the pneumatic timer. Subsequent firing then occurs when the appropriate timer discs dictate.

Figure 7:
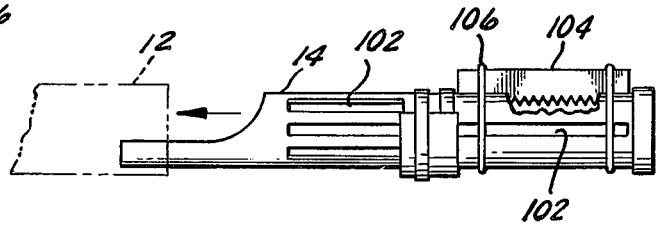
FIG. 7 is a side view of a tennis ball extension barrel.

Also shown in FIG. 1, is a barrel extension 14 which may be any of those shown and described in my earlier application. It also may be another tennis ball version, as shown in FIG. 7, having a plurality of air bleed slots 102 along the ball path. In one of the slots is a strip 104 resiliently held in place by elastic bands 106. On the inner edge of strip 104 and extending into the path of the ball may be bristles, rubber teeth or other friction aides to impart a spin on a ball passing through the extension. The strip may be placed in a selected slot for side, up or down spin as desired. The elastic bands 106 expand and let strip 104 move outwardly as the ball passes under it. In this manner precise inward adjustment of strip 104 to compensate for old or slick balls or balls of slightly different diameter is unnecessary, since each ball passing through urges strip 104 outwardly sufficiently to permit its passage while imparting the desired spin action upon it. As can be seen in FIG. 7, the barrel extension 14 not only extends forwardly of barrel 12, but it also has a section of reduced diameter (for tennis ball passage) that fits down into the barrel.

FIGS. 2, 3, 4, 5 and 6 show how the adjustable and variable timer and speed control is constructed and operates. In FIG. 2 the timer motor 72 and switch valve 76 are shown mounted below barrel 12 and forwardly of air supply tank 10. The motor rotates disc 74 to initiate lateral oscillation of the barrel when actuator rod 80 is engaged. On the rotating shaft 108 is mounted a pair of rotatably adjustable timing discs 110,112 which, when they are in radial alignment, permit movement of an actuating lever 114 on pneumatic valve 116 which controls passage of air between lines 94 and 96, as shown in FIG. 3. Lever 114 has a roller 118 on the end which is as wide as both discs 110,112 as shown in FIG. 4. Only when notches on both discs are in alignment will the roller 118 fit into them and permit the lever 114 to move, as shown in FIG. 3. Set screws or detents permit desired rotation and fastening of the discs on shaft 108.

Each disc 110,112 has radially opposed wide and narrow notches 120, 122, 124 and 126, as shown in FIGS. 5 and 6. Thus, by proper rotation of the discs 110,112, ball firing, i.e., valve actuation, occurs rhythmatically once every 360°, once every 180°, or at 150° and 360° spacing and also rotation of disc 74, as desired. This provides for alternate firing in relatively faster and slower sequence to eject tennis balls along different positions across the tennis court. This non-uniform firing also varies the speed of the ball since the pressure in the ball ejection tank is less when rapid firing occurs and is greater for the slower firing sequence.

Figure 8:
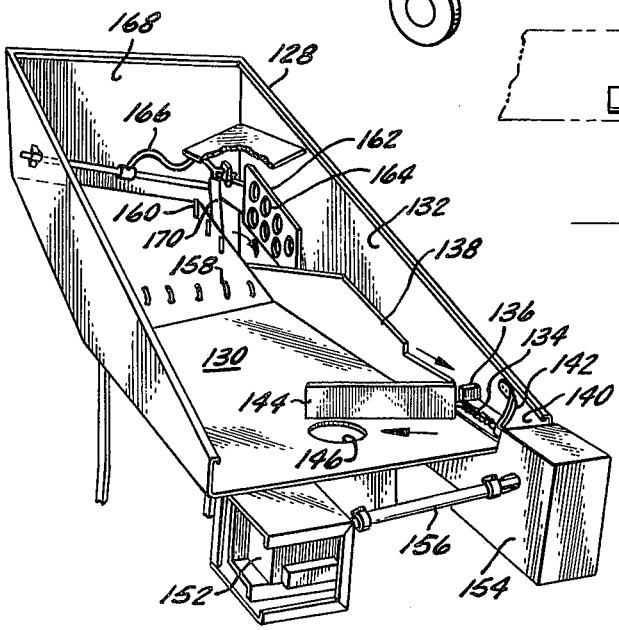
FIG. 8 is a perspective view of the hopper taken along line 8—8 in FIG. 1.

The hopper and feed mechanism 16 will accommodate up to 200 tennis balls without jamming or malfunction and without operator assistance. This is shown in FIGS. 1, 2 and 8. This includes a hopper 128 with a bottom 130 sloping downwardly to the rear and one side 132. An endless chain 134 with scoops 136 carries balls from the lower rear end of the hopper, between side 132 and wall 138 to the upper forward end 140 where the balls are deflected by deflector 142 and roll down a ramp 144 and into a hole 146 in bottom 130. The scoop and chain arrangement and hopper configuration is such that balls are fed to the hole when the barrel is tilted through a variety of pitch attitudes. A chute 148 under hole 146 conveys the balls down to opening 150 in barrel 12. (The firing of the balls through barrel 12 under air pressure is the same as in my earlier mentioned co-pending application and need not be further discussed here as it is not part of the present invention except in combination therewith). When chute 148 is full, hole 146 is full and the balls simply roll back down bottom 130 for recycling. In order to feed tennis balls to the chute 148 at a faster desired rate (baseballs fire once per revolution of the timing discs and tennis balls fire twice per revolution), the endless chain 134 in conveying tennis balls must travel at twice its speed in conveying baseballs. This may be done with a variable speed motor 152, which drives a chain sprocket in housing 154 or by having two different sized drive sprockets interchangeable for the desired operational mode. When different sprockets are used, flexible drive coupling 156 permits and compensates for the resulting sprocket axle misalignment with the drive motor.

Anti-clogging and anti-jamming features and apparatus within the hopper 128 assure a reliable flow of balls to the conveyor chain 134 and thus to the chute 148 and firing barrel 12. These include a plurality of laterally spaced pins 158 alternately protruding up through the bottom 130, a pivotal vertically moving anti-jamming plate 162 adjacent side 132 and having a plurality of holes 164 therein, and a nudging bar 166 which rotates on an axis along the back wall 168, all as shown in FIG. 8. Both plate 162 and nudging bar 166 are actuated by a crank 170 that is moved by a scoop 136 on the endless chain 134 as it moves along.

In FIG. 2 it can be seen that the hopper and feed mechanism 16 is tripod mounted. Downwardly extending brackets 174,176 attach to arms 58,60 of mounting support 56, along with air supply tank 10. A support bracket 178 under chute 148 rests on firing barrel 12. Rocker arm 172 is pivotally connected to bracket 176. A portion 180 of arm 172 extends forwardly of this pivot to correspond with arm 182 which is pivotally mounted on bracket 174. Between portion 180 and arm 182 is a pin mounting bar 184 on which pins 158 extend upwardly through holes in the bottom 130 of hopper 128. Pins 160 extend upwardly on rocker arm 172 and through holes in bottom 130 also. It can be seen that as bar 184 moves down to withdraw pins 158, rocker arm 172 moves up along with its pins 160. Conversely, when bar 184 moves up, pins 158 protrude and pins 160 are withdrawn. Although not shown, crank 170 is also pivotally mounted to rocker arm 172. A tension spring 186 tends to keep pin mounting bar 184 down and rocker arm 172 up except when actuation occurs. Bar 184 has an actuating bar 188 extending down in front of the path of travel of pin 190 on barrel closure 192. Just prior to firing, barrel closure 192 moves forwardly (as explained in my co-pending application), and pin 190 moves actuating bar 188 forwardly and upwardly against the force of spring 186. Thus it can be seen that with every ball firing the anti-clogging and anti-jamming structure is actuated to insure a steady flow of balls to the scoops 136 on endless chain 134 and hence to firing barrel 12.

Having described an illustrative embodiment of my invention, other versions and modifications will occur to those skilled in the art, and it is to be understood that these variations are part of my invention as claimed.

What is claimed is:

1. A compressed air ball projecting machine having an ejection barrel to receive and eject balls, an air supply tank for subjecting a ball in said barrel to compressed air to eject said ball from said barrel, moving means for moving said barrel through lateral oscillations as balls of one type are cyclically ejected from said barrel to vary the direction of ejection of said balls, an air line through which compressed air is pumped into said air supply tank, valve means in said air line to regulate the flow of air therethrough, said valve means having an actuating lever the position of which determines the passage and non-passage of air through said valve means, a pair of notched discs engageable with said actuating lever, a timing motor for rotating said notched discs past said actuating lever to change the position thereof in accordance with the rotational position of the notches on said discs, said lever having an end with a thickness approximately equal to the thickness of said pair of discs whereby said actuating lever is moved only upon axial alignment of notched portions of both discs moving past said actuating lever, said discs being further selectively rotatable relative to each other to vary the axial alignment of said notched portions.

2. A compressed air ball projecting machine as set forth in claim 1, and stabilizing means for stabilizing the direction of said barrel for ball ejection when balls of another type are used.

3. A compressed air ball projecting machine as in claim 1 wherein said discs have notches adjustably positioned to move said actuating lever selectively once every 360° of rotation of said discs, once every 180°, and once at 150° and 360° spacing.

4. A compressed air ball projecting machine having an ejection barrel to receive and eject balls, an air supply tank for subjecting a ball in said barrel to compressed air to eject said ball from said barrel, moving means for moving said barrel through lateral oscillations as balls of one type are cyclically ejected from said barrel to vary the direction of ejection of said balls, said moving means comprising a rotating disc, an acutator rod pivotally mounted on said disc at a pivot point spaced from the center thereof for circular movement of said rod, a pair of fingers having said rod positioned therebetween for vertical movement, and an eye bolt positioned between said disc and said fingers and having said rod extending therethrough, said machine being pivotally mounted and having said eye bolt connected thereto whereby rotation of said disc causes lateral movement of said eye bolt and thus oscillation of said machine.

5. A compressed air ball projecting machine as set forth in claim 4, and stabilizing means for stabilizing the direction of said barrel for ball ejection when balls of another type are used.

6. A compressed air ball projecting machine as set forth in claim 4 wherein the eye of said eye bolt is vertically moveable to adjust the range of oscillation of said machine as desired.

* * * * *